US005632677A

United States Patent [19]

Elkins

[11] Patent Number: 5,632,677

[45] Date of Patent: May 27, 1997

[54] FAN-EQUIPPED AIR DELIVERY VENT

[76] Inventor: Larry V. Elkins, 4950 E. Baseline Rd., Columbus, Ind. 47201

[21] Appl. No.: 529,097

[22] Filed: Sep. 15, 1995

[51] Int. Cl.[6] ..... F24F 13/075; F24F 7/06

[52] U.S. Cl. ..... 454/329; 454/338

[58] Field of Search ..... 454/329, 338

[56] References Cited

U.S. PATENT DOCUMENTS

| | | | |
|---|---|---|---|
| 1,645,140 | 10/1927 | Herbruck . | |
| 1,875,683 | 9/1932 | Waterbury . | |
| 1,875,684 | 9/1932 | Waterbury . | |
| 2,043,934 | 6/1936 | Spear . | |
| 2,525,157 | 10/1950 | Trane . | |
| 2,972,941 | 2/1961 | Bennett . | |
| 3,099,201 | 7/1963 | Gottlieb . | |
| 3,148,613 | 9/1964 | Koon . | |
| 4,212,233 | 7/1980 | Shaffer . | |
| 4,710,096 | 12/1987 | Erlam | 454/329 X |
| 4,722,266 | 2/1988 | Deckert . | |
| 4,754,697 | 7/1988 | Asselbergs . | |
| 4,809,593 | 3/1989 | Asselbergs | 454/329 X |
| 4,846,399 | 7/1989 | Asselbergs . | |
| 5,054,380 | 10/1991 | Hubbard | 454/329 X |
| 5,489,238 | 2/1996 | Asselbergs | 454/329 |

OTHER PUBLICATIONS

"Improvements" catalog, Model 49254–blower booster 2 and in–duct booster fan, pp. 58 and 59 (1994).

*Primary Examiner*—Harold Joyce

*Attorney, Agent, or Firm*—Woodard, Emhardt, Naughton, Moriarty & McNett

[57] ABSTRACT

A fan-equipped air delivery vent for installation into a structure in order to enhance the flow of air from a heating/cooling system includes a main housing portion arranged as a generally rectangular box having an air entrance side closest to the heating/cooling system main blower and an air exit side closest to the interior of the room or space which receives the heated or cooled air. Positioned across the air exit side of the main housing portion is a covering register panel which is arranged with two sections of air-flow louvers. Positioned across the air entrance side of the main housing portion is an enclosing panel which has three air-entrance apertures positioned therein. Mounted to the enclosing panel and positioned within the main housing portion are three electric fans which are wired in parallel and controlled by an ON-OFF switch and thermostat. Each of the three electric fans is positioned in alignment with a plurality of louvers on the exit side and with one of the three air-entrance apertures on the inlet side. The enclosing panel and the defined air-entrance apertures ensure that virtually all of the air delivered by the heating and cooling system will flow through the three electric fans and that the fans will conduct relatively clean filtered air. The backflow of dirty air across the tips of the fan blades is restricted by the design of the air delivery vent.

4 Claims, 4 Drawing Sheets

FAN-EQUIPPED AIR DELIVERY VENT

BACKGROUND OF THE INVENTION

The present invention relates in general to the design of forced air heating and air conditioning systems and the problem of poor or insufficient air delivery and circulation. More specifically the present invention relates to a fan-equipped air delivery vent which can be used for increased air delivery and enhanced air circulation in those situations and in those locations where the conventional forced air heating or air conditioning is not adequate.

A centralized forced air handling system represents the preferred choice and the most commonly installed type of system. The design of such a system and its installation provide a number of benefits for the heating and cooling of a structure, such as a residence. However, there are also certain shortcomings, principally air delivery and circulation problems associated with such centralized systems. The air delivery and circulation problems are created by the use of a single, central blower to force the heated or air conditioned air up through the network of air ducts to the various rooms and living spaces of the structure. The air duct paths differ from room to room in both their specific routing as well as their length or distance from the central blower.

Realizing that the forced air, whether heating or cooling, will not flow in a uniform and balanced fashion equally to every corner of every room, there exists the potential for certain rooms and spaces which are farther from the blower to receive inadequate air flow and as a result inadequate heating or cooling. Sometimes the various curves and bends of the air ducts contribute to the inadequate or insufficient air delivery. In other arrangements, it may simply be the distance from the central blower which is the primary contributor to inadequate air delivery. Regardless of the specific reasons, when the air delivery to a particular room or space is not sufficient to provide adequate heating in the winter and cooling in the summer, there is a need to improve upon the system so as to correct this problem. Merely increasing the air delivery (volumetric flow) rate from the centralized blower is not the answer. As indicated, there are only certain rooms and spaces which are receiving an adequate air flow. There are typically other portions of the structure which are in a more direct line with the blower and/or at a shorter distance away from the blower which are adequately heated and cooled. In some instances, these areas might already be receiving too much air flow due to the difficulties in trying to balance out the heating and cooling in all corners of a large structure, such as a two story home. In order to solve the problem of certain rooms or spaces being too cold in the winter and too warm in the summer, some corrective measure needs to be taken on a room-by-room basis.

Associated with inadequate air flow is the air circulation reality that cooler air settles in the lower regions of a room or structure and that warmer air rises. When dealing with a two story home, for example, this is another factor which influences whether all of the various rooms will be somewhat balanced as to their heating and cooling temperatures. As noted, since the central system relies on a single blower (air delivery device) to satisfy the air delivery requirements for all rooms, the chance for variations and inadequate air delivery to certain more remote rooms is relatively high. In order to solve the aforementioned problem which is associated with conventional forced air handling systems, designs have been conceived to introduce a supplemental flow of air (fan-driven) between the main blower and the room or space which has an insufficient air flow. Typically such designs are positioned near or in the air delivery duct which is associated with the particular room or space. Many of these supplemental designs are best described as fan-equipped air delivery devices and in certain arrangements are self-contained as a separate module.

While the following listed patents are typical of these earlier fan-equipped air delivery devices, each one represents a slightly different approach to the problem of air delivery and circulation:

| PATENT NO. | PATENTEE | ISSUE DATE |
|---|---|---|
| 1,645,140 | Herbruck | Oct. 11, 1927 |
| 1,875,683 | Waterbury | Sep. 6, 1932 |
| 1,875,684 | Waterbury | Sep. 6, 1932 |
| 2,043,934 | Spear | Jun. 9, 1936 |
| 2,525,157 | Trane | Oct. 10, 1950 |
| 2,972,941 | Bennett | Feb. 28, 1961 |
| 3,099,201 | Gottlieb | Jul. 30, 1963 |
| 3,148,613 | Koon | Sep. 15, 1964 |
| 4,212,233 | Shaffer | Jul. 15, 1980 |
| 4,722,266 | Deckert | Feb. 2, 1988 |
| 4,754,697 | Asselbergs | Jul 5. 1988 |
| 4,846,399 | Asselbergs | Jul. 11, 1989 |
| 5,054,380 | Hubbard | Oct. 8, 1991 |

Two additional devices are disclosed in the Fall 1994 issue of the "Improvements" catalog detailing "quick and clever problem solvers". On page 58 there is a model 49254-blower booster 2 offered for sale and on page 59 an in-duct booster fan. The devices detailed by the listed patents and by the "Improvements" catalog can, for the most part, be grouped into two general categories. In one category, a fan is simply placed in an existing conduit or duct prior to or upstream from the room register (vent). In the other category, the fan is preassembled into a module which is typically mounted onto the exterior of the room register. Often associated with each category are various brackets, baffles, conduits, and controls which have specific functions to control, route or in some way try to enhance the air delivery. While the objective of each design is to enhance the flow of air through a duct or conduit into a room or space, the specifics of the construction of each device and the functional subtleties of each device provide points of differentiation. These points of differentiation contribute to different patentable inventions.

Although several patents have been granted, there remain a number of shortcomings and drawbacks with each of these earlier inventions. For example, many of the earlier designs are fashioned on the theory of one-size fits all, without regard to the size of the room which is not getting adequate air flow. Other designs position the fan in a wide open area without any enclosure or shroud, thereby allowing inefficient air flow patterns and the recirculation of "dirty" air back into the fan by way of any clearance around the outermost tips of the fan blades. As to those earlier designs which provide only a constantly ON or OFF mode of operation, there is no ability to control when additional air flow should be provided based on the temperature within the room. As to those designs which mount externally to the existing vent, whether over or onto a wall or floor register, what results is a cumbersome device which interferes with the free movement into and out of the room and which restricts the positioning of furniture within the room.

As to those designs which are not modular or otherwise self-contained, the existing register must be removed and access provided to the interior of the air delivery duct. The additional attachment of various brackets and supports for positioning the fan in the duct must also be performed piece-by-piece and this results in a substantial inefficiency as to both cost and labor time.

After carefully reviewing all of the listed patents and evaluating the shortcomings and design inefficiencies with each, the present invention was conceived and perfected. The present invention is designed to accept one, two, three or more fans in the same sized, self-contained module, depending on room size requirements and vent opening/size restrictions. Therefore, while the register-sized modular unit maintains its external size and compatible fit within the floor or wall opening, the invention can be styled to accept a different number of fans. In this manner, the size of the room can be factored into the selection of the specific style of the present invention. The present invention is a modular design which includes a standard register. The present invention module is designed to fit conveniently and efficiently into the existing register opening, whether in a floor or wall. A thermostat control and separate ON-OFF switch enable the operation to be tailored to either heating or cooling requirements.

Importantly, the present invention also includes a rear enclosing panel which cooperates with fan shrouds to seal closed the flow avenues which might permit a recirculation path for "dirty" air. When dirty air is drawn back in across the tips of the fan blades, it reduces the life of the motor. The present invention handles only clean, filtered air directly from the furnace (or air conditioner). The air inlet apertures in the enclosing panel (one for each fan) are directly in line with the fan axis of rotation and in line with the exit flow path from each fan. This direct flow path contributes to the efficiency of the design and reduces the load on each fan.

The present invention also provides a selective combination of several unique features which have heretofore not been combined in any single device. This combination of features is novel and unobvious and provides various advantages over the prior art.

SUMMARY OF THE INVENTION

A fan-equipped air delivery vent for installation into a structure in order to enhance the flow of air from a heating/cooling system according to one embodiment of the present invention comprises a housing portion having an air entrance side and an air exit side and defining an interior space therebetween, a covering register panel positioned across the air exit side, the covering register panel being constructed and arranged with a plurality of air-flow louvers, a plurality of electric fans each having an exit air flow direction and each being positioned in the interior space, each of the plurality of electric fans being arranged so as orient the exit air flow direction through the plurality of air-flow louvers and an enclosing panel attached across the air entrance side, the enclosing panel defining a plurality of air-entrance apertures, there being one air-entrance aperture associated with each one of the plurality of electric fans.

DESCRIPTION OF THE PREFERRED EMBODIMENT

Figure 1:
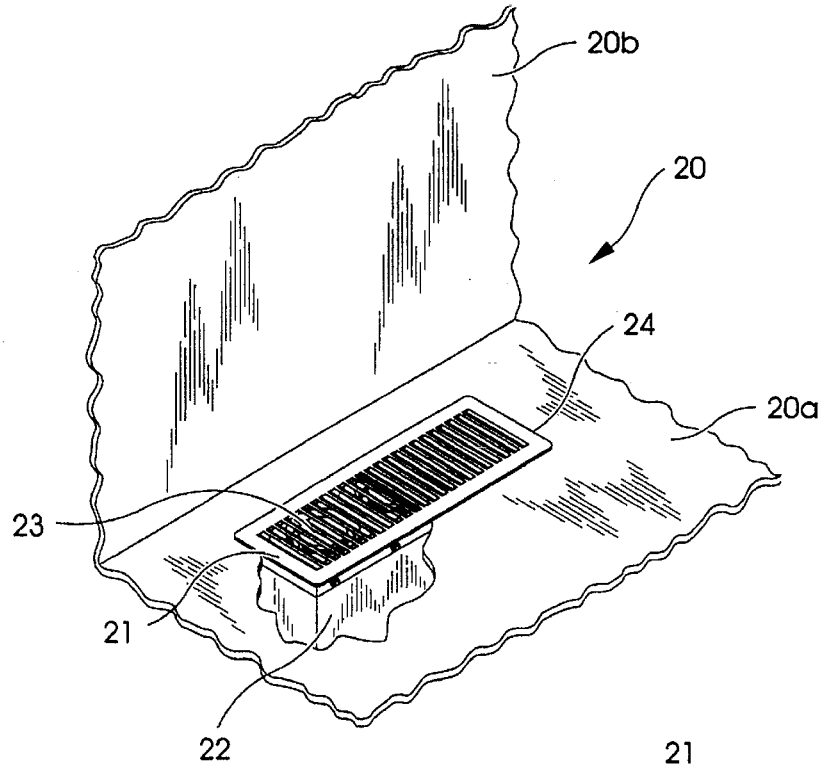
FIG. 1 is a fragmentary, perspective view of a portion of a structure with a fan-equipped air delivery vent according to a typical embodiment of the present invention installed in a floor duct.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Referring to FIG. 1 there is illustrated a portion of a structure 20 with a floor mounted, fan-equipped air delivery vent 21 which is designed according to the present invention. Fan-equipped air delivery vent 21 has the outward appearance of a conventional floor (or wall) air-delivery register. The fans, controls, and housing structure associated with air delivery vent 21 are positioned within the corresponding duct 22 that communicates with the air delivery vent 21. As illustrated, vent 21 is mounted into floor 20*a* and the outer peripheral frame 24 of register panel 23 is sized larger than the corresponding floor cut out (rectangular) so as to abut up against the top surface of the floor edges which define the floor cut out. This particular configuration can be seen in FIG. 3.

Figure 3:
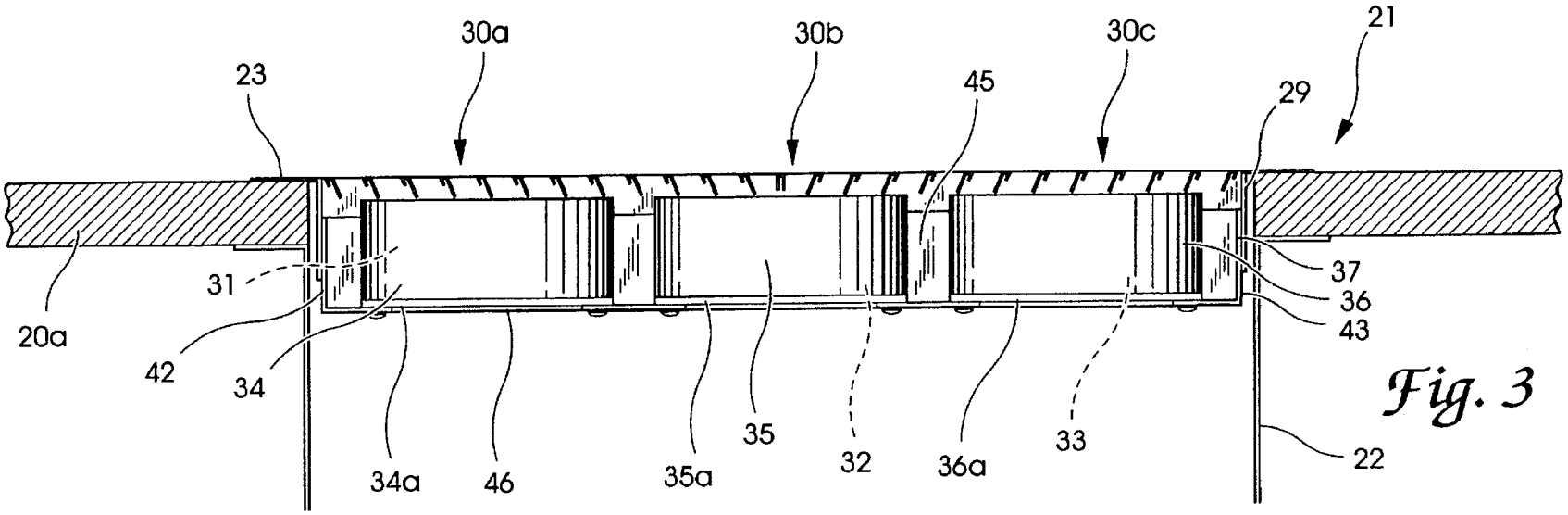
FIG. 3 is a side elevational view in partial section illustrating the positioning of the FIG. 2 fan-equipped air delivery vent in the floor of the FIG. 1 structure.

As an alternative to the FIG. 3 mounting arrangement, air delivery vent 21 could be mounted into a wall duct located in a vertical wall portion of the structure, such as wall 20*b* in the FIG. 1 representation. This of course assumes that there is a corresponding air delivery duct leading from the furnace and/or air conditioner to the particular room or space and in fact exits through some portion of the vertical wall 20*b*.

Figure 2:
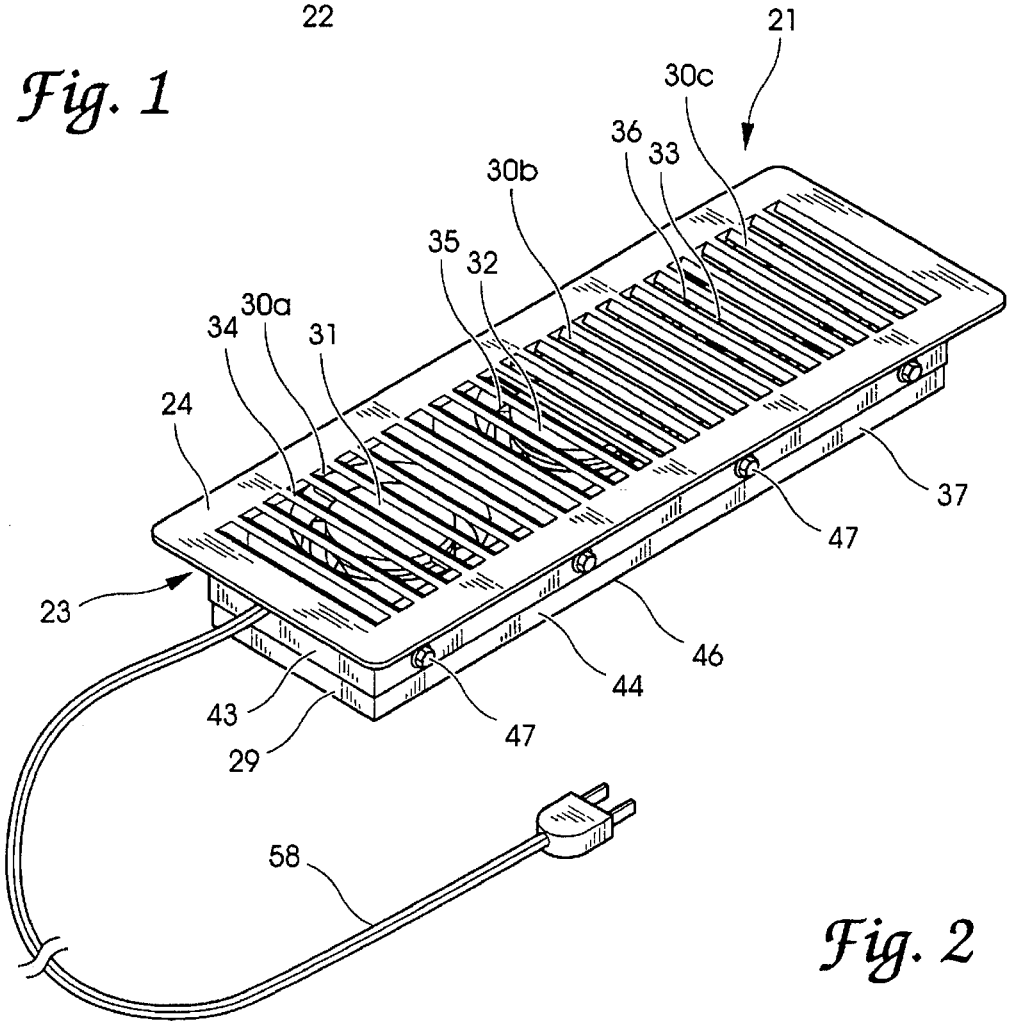
FIG. 2 is perspective view of the FIG. 1 fan-equipped air delivery vent.
Figure 4:
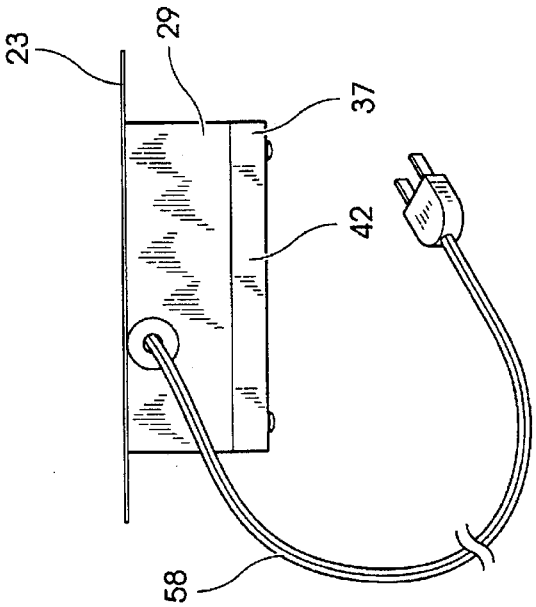
FIG. 4 is an end elevational view of the FIG. 2 fan-equipped air delivery vent.

Referring to FIGS. 2–4, the general shapes, proportions and relationships of air delivery vent 21 are illustrated. Main housing portion 29 houses the electric fans and various controls associated with air delivery vent 21. Main housing portion 29 is shaped as a rectangular solid and is sized to fit within the corresponding air delivery duct, regardless of the exit location for the duct, whether through a floor opening or through a wall opening. Register panel 23 is generally rectangular with a plurality of evenly spaced, substantially parallel louvers 30*a*–*c*. In the three-fan arrangement which is illustrated, there are two primary styles or options for the parallel louvers. The option which is illustrated is to have one half of the louvers angled to the left (louvers 30*a* and a portion of 30*b*) and the other half angled to the right (louvers 30*c* and the remainder of 30*b*). This is clearly shown in FIG. 3. The other option which is not illustrated is to have three separate sections of louvers. Roughly one third of the louvers 30*a* (those on the left side) are angled to the left. Another one third of the louvers 30*b* which are located in the middle are not angled. Finally, the last one third of the louvers 30*c* are positioned on the right hand side and are angled to the right. Either arrangement of louvers creates an outwardly radiating flow pattern for the exiting air so as to better distribute the air, whether heated or air conditioned, throughout the room or space.

A different electric fan, 31, 32, and 33, is positioned beneath a corresponding series of louvers so as to increase the flow rate and distribution of heated or cooled air into the room. Each fan is contained within its own generally cylindrical shroud 34, 35, and 36, and each shroud is integral with a corresponding mounting flange 34*a*, 35*a*, and 36*a*, which is generally rectangular and which is mounted directly to the rear enclosing panel 37 by four screws 38 (see FIG. 5).

Enclosing panel 37 is a generally rectangular sheet metal form with two end and two side flanges 42, 43, 44, and 45 folded at right angles to base 46 so as to attach to the main housing portion 29 by way of sheet metal screws 47. Alternatively plastic can be used for enclosing panel 37. Pop rivets can be used in lieu of screws 47. Main housing portion 29 is generally rectangular and attaches to register panel 23. In one embodiment of the present invention the main housing portion 29 is constructed integrally with register panel 23.

It should be understood that main body portion 29 includes an air entrance side which is adjacent enclosing panel 37 and an air exit side which is adjacent register panel 23. With register panel 23 positioned across the air exit side of the main housing portion 29, whatever air leaves the main housing portion, whether by flow due to the central blower or by enhanced flow due to the fans, this air will be propelled into the corresponding room by passing through the louvers of the register panel. Further, the enclosing panel 37 is positioned across the air entrance side of the main housing portion 29 and this overall assembly is important to control what air may be introduced into the main housing portion. By enclosing the three electric fans 31–33, not only within their own individual shroud 34–36, respectively, but within the main housing portion 29, and then by providing the enclosing panel 37, the only air that actually passes through the main housing portion and from there out into the room will be relatively clean and filtered air which is delivered directly from the furnace/air conditioner by way of the corresponding air delivery duct.

What is created by the assembly of register panel 23, main body portion 29, and enclosing panel 37 is a self-contained, modular, box-like structure which has the shape of a rectangular solid within which the three electric fans are positioned. The modular or self-contained nature of this assembly allows it to be installed quickly and efficiently in the floor opening and into the corresponding air delivery duct 24 which communicates with the floor opening (or wall opening if that arrangement is present).

Figure 5:
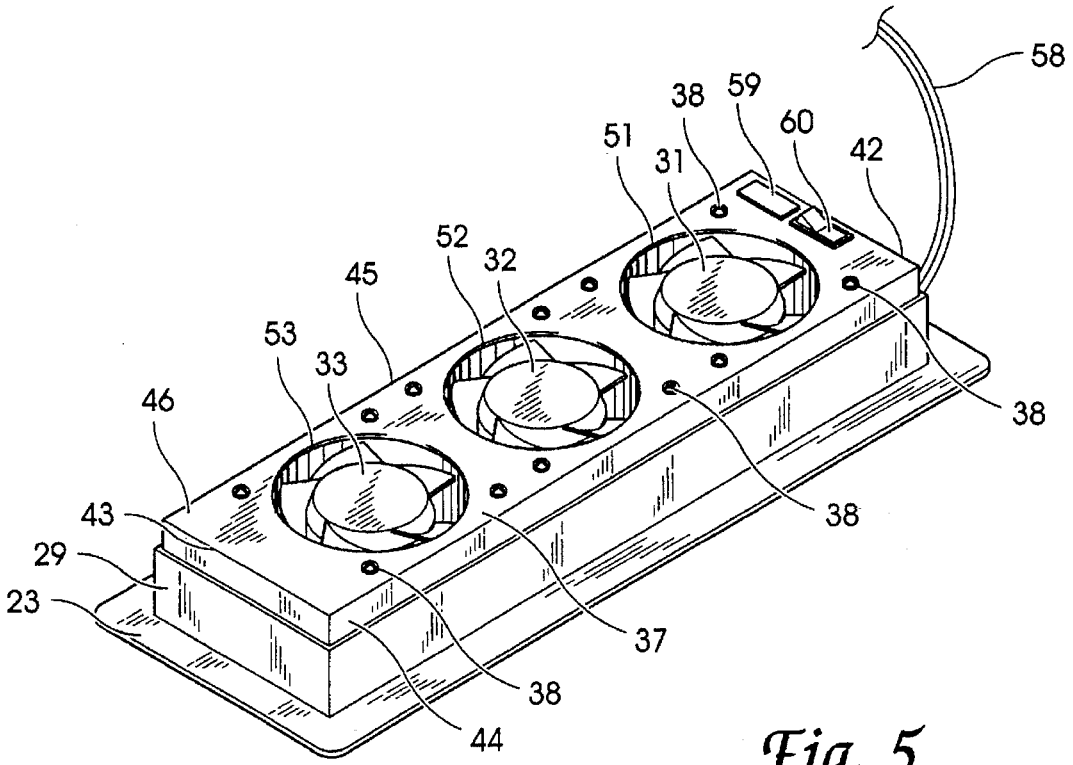
FIG. 5 is a rear perspective view of the FIG. 2 fan-equipped air delivery vent.
Figure 6:
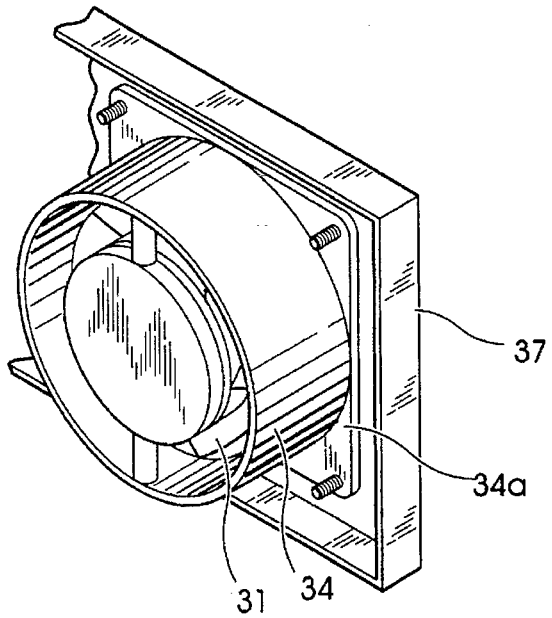
FIG. 6 is a perspective view of the mounting of one fan to a rear enclosing panel according to the present invention.
Figure 7:
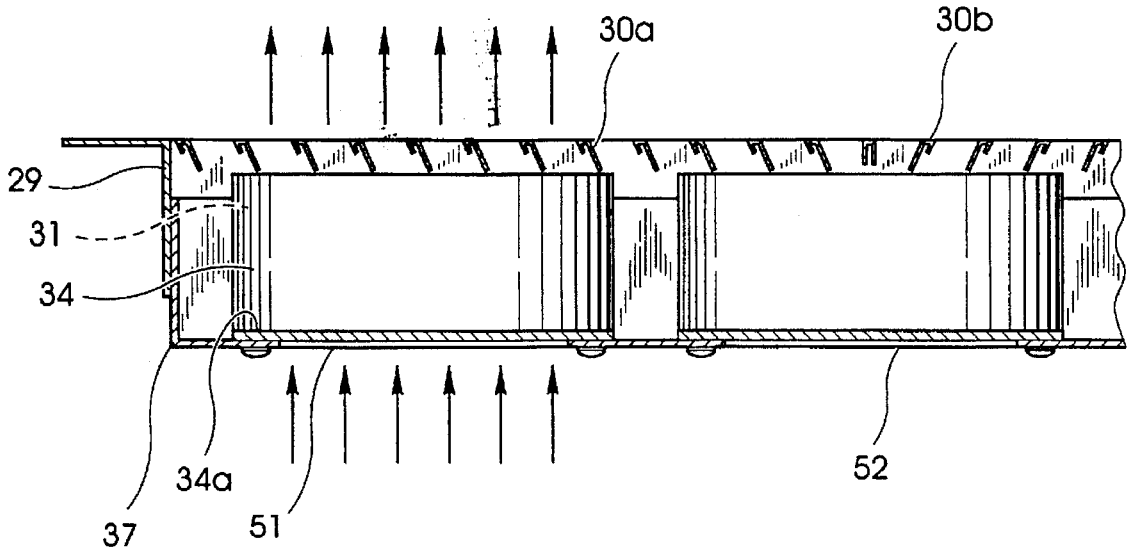
FIG. 7 is a diagrammatic illustration of the air flow path through the FIG. 2 fan-equipped air delivery vent.

Referring to FIGS. 5 and 6, enclosing panel 37 which is substantially flat across the outer surface of base 46 defines three evenly-spaced circular openings 51, 52, and 53. Each opening is aligned with a corresponding one of the three fans, 31–33. With the shroud flanges 34*a*–36*a* directly mounted to the inside surface of panel 37, there is a limited though direct flow path for air. The flow path is "limited" because air cannot flow in from the sides or backflow around the tips of the fan blades. The first step to establish the desired flow path is to place the fan blades inside a closely-sized shroud. The next step is to axially position one end of the shroud up against the exit louvers and the opposite end against the inside surface of panel 37. What results is a tunnel-effect where virtually all of the air which exits from the louvers of register panel 23 enters by way of the three openings 51–53. These three openings 51–53 in the enclosing panel 37 each have a diameter size which is substantially the same as the diameter dimension across the outer tips of the fan blades. In this way, there are no air flow restrictions nor any excess clearances which might allow "dirty" air to be drawn in back across the outer tips of the fan blades. All of the air which exits from the register panel 23 into the room or space is filtered air from the furnace/air conditioner, all of which comes directly through the corresponding floor or wall delivery duct up to enclosing panel 37 and from there through the three circular openings 51–53 (see FIG. 7). In FIG. 6 the mounting of one fan shroud to the inside surface of the enclosing panel 37 is illustrated.

By preventing any "dirty" air from circulating across the tips of the fan blades, the life of the fan motors is enhanced and the air flow is cleaner. The three fans 31–33 are wired in parallel such that a failure of one does not affect the operation of the others. Power cord 58 (see FIGS. 2,4 and 5) exits from a side wall of main body portion 29 and internally the power cord branches off to each of the three electric fans 31–33 where the electrical connection is hardwired. An alternative exit path for the power cord 58 is to route the power cord out through one of the end louvers. Included in the electrical power circuit is a thermostat 59 and an ON-OFF control 60 (see FIG. 5). The electrical network is designed for a constantly ON operation during the summer months, whether or not the air conditioner is in use. Even if the air conditioner is not actually blowing out cool air, the air movement due to the three fans helps to some extent with cooling with the room or space and this is why the fans are able to be turned on for continuous air movement. During the winter months or whenever heating is necessary, the thermostat responds to the temperature of the air delivered to the vent. Whenever the delivered air temperature equals the activation temperature set on the thermostat, the three fans are energized so as to assist in the delivery of the heated air into the room or space. The three fans provide a boost to the air flow rate from the furnace (or air conditioner) so as to generate a greater flow rate when the unassisted flow would not be adequate for proper heating or cooling.

Although three fans are illustrated, it is to be understood that one or two fans could be used in the same sized unit and the determination of how many fans should be provided depends upon the size of the room or space and the degree or extent that supplemental air flow is required. One possible arrangement would be to use one fan for those register locations which are relatively close or in direct line with the central blower but still not receiving adequate air flow for the desired heating or cooling. In evaluating the layout of the structure and considering those register locations which are somewhat farther away from the central blower, two fans might be appropriate. Finally, the most remote portions of the structure would require three fans.

Another option with regard to the present invention is to provide an ON-OFF control switch for each of the three fans so as to allow greater versatility and tailoring of the air flow for a particular room. Depending on personal preferences, it might be desired to maximize the air flow under certain conditions and at certain times of the year, but for that same room have a reduced air flow at other times of the year. A single fan-equipped air delivery vent with individual ON-OFF controls for each fan would be suitable for this purpose.

Finally, by using the design of a modular unit which can simply be dropped in place through the existing floor or wall cut out, and by the use of an enclosing panel which directs all of the incoming air from the air delivery duct through the three apertures, all of the normal air flow from the central blower is handled by the present invention. This air flow is not allowed to leak out past the enclosing panel nor bypass the enhanced air delivery via the three fans. This ensures that all of the air which otherwise comes through the air delivery duct will be processed and given an added boost by the present invention.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. In combination:

a floor portion of a structure defining a substantially rectangular opening;

an air delivery duct extending from below said floor portion in the direction of said opening; and a modular air delivery vent attached to said floor portion and being disposed in said air delivery duct, said air delivery vent comprising:

a housing member defining an air entry aperture and including an outlet flow register defining a plurality of outlet air flow passageways;

a plurality of fans positioned within said housing member and arranged to increase the air flow rate of air flowing between said air entry aperture and said outlet air flow passageways; and an enclosing panel attached to said housing member and extending across said air entry aperture, each of said plurality of fans being mounted to said enclosing panel, said enclosing panel defining a plurality of air-entrance apertures, there being one air-entrance aperture aligned with each one of said plurality of fans.

2. The combination of claim 1 wherein said plurality of fans includes a total of three fans and wherein said enclosing panel includes three air-entrance apertures.

3. The combination of claim 1 wherein each of said plurality of fans is an electric fan and said plurality of fans is wired in parallel.

4. The combination of claim 3 which further includes a thermostat connected to said plurality of electric fans for triggering the operation of said plurality of electric fans based upon incoming air temperature.

* * * * *